US008289120B2

(12) United States Patent
Tada

(10) Patent No.: US 8,289,120 B2
(45) Date of Patent: Oct. 16, 2012

(54) ELECTRONIC COMPONENT, VEHICLE AND ELECTRONIC APPARATUS

(75) Inventor: Koji Tada, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/960,244

(22) Filed: Dec. 3, 2010

(65) Prior Publication Data

US 2011/0199176 A1 Aug. 18, 2011

(30) Foreign Application Priority Data

Feb. 17, 2010 (JP) ..... 2010-032959

(51) Int. Cl.
*H01F 27/30* (2006.01)
*H01F 27/29* (2006.01)

(52) U.S. Cl. ..... 336/198; 336/208; 336/192

(58) Field of Classification Search ..... 336/198, 336/208, 192, 145, 182
See application file for complete search history.

(56) References Cited

U.S. PATENT DOCUMENTS 2,941,173 A * 6/1960 Gollub ..... 336/155
5,917,397 A * 6/1999 Sasahara ..... 336/206
5,959,521 A * 9/1999 Kohmura et al. ..... 336/198
6,344,787 B1 * 2/2002 McGrane et al. ..... 336/198
6,459,586 B1 * 10/2002 Miller et al. ..... 361/719
2003/0098768 A1 5/2003 Hoffmann et al.
2005/0140485 A1 6/2005 Chang
2005/0275498 A1 * 12/2005 Haga ..... 336/208
2007/0035374 A1 2/2007 Watanabe et al.
2007/0052513 A1 3/2007 Chang
2008/0100407 A1 5/2008 Yamaguchi et al.
2008/0143276 A1 6/2008 Hsueh et al.
2008/0180205 A1 7/2008 Tsai et al.
2008/0308662 A1 12/2008 Yang
2009/0066459 A1 3/2009 Chih
2009/0108976 A1 * 4/2009 Nerone et al. ..... 336/192
2009/0151153 A1 6/2009 Liu et al.
2009/0153280 A1 6/2009 Chen et al.
2009/0278646 A1 11/2009 Chen et al.
2010/0013588 A1 1/2010 Sakuma
2010/0026445 A1 2/2010 Lin et al.
2011/0043315 A1 * 2/2011 Kobayashi et al. ..... 336/192
(Continued)

FOREIGN PATENT DOCUMENTS

JP 01-135719 9/1989
(Continued)

OTHER PUBLICATIONS

Japanese Patent Application No. 2010-032959, Notice of Reasons for Rejection, mailed Apr. 12, 2011, (with English Translation).

*Primary Examiner* — Mohamad Musleh
*Assistant Examiner* — Mangtin Lian
(74) *Attorney, Agent, or Firm* — Blakely, Sokoloff, Taylor & Zafman LLP

(57) ABSTRACT

According to one embodiment, an electronic component includes a cylindrical former proper, a thick portion provided at the end of the former proper and projecting from the outer surface of the former proper, a connecting portion adjacent to the thick portion including a terminal assembly, and a wire wound around the former proper and electrically connected to the terminal assembly. The thick portion includes a first retaining portion in which the wire running from the terminal assembly to the former proper is retained.

7 Claims, 6 Drawing Sheets

U.S. PATENT DOCUMENTS

| | | | |
|---|---|---|---|
| 2011/0090037 | A1 | 4/2011 | Tsai et al. |
| 2011/0248813 | A1 | 10/2011 | Noda et al. |
| 2012/0001717 | A1 | 1/2012 | Park et al. |

FOREIGN PATENT DOCUMENTS

| | | |
|---|---|---|
| JP | 2-224212 | 9/1990 |
| JP | 4-099811 | 3/1992 |
| JP | 05-95019 | 12/1993 |
| JP | 06-41116 | 5/1994 |
| JP | 7-263238 | 10/1995 |
| JP | 8-203753 | 8/1996 |
| JP | 8-264348 | 10/1996 |
| JP | 9-162042 | 6/1997 |
| JP | 9-223631 | 8/1997 |
| JP | 11-144936 | 5/1999 |
| JP | 2000-100619 | 4/2000 |
| JP | 2006-012989 | 1/2006 |
| JP | 2007-012944 | 1/2007 |
| JP | 2007-335453 | 12/2007 |
| JP | 2008-112753 | 5/2008 |
| JP | 2008-205153 | 9/2008 |
| JP | 2009-105342 | 5/2009 |
| JP | 2010-027747 | 2/2010 |

* cited by examiner

ELECTRONIC COMPONENT, VEHICLE AND ELECTRONIC APPARATUS

CROSS-REFERENCE TO RELATED APPLICATIONS

This application is based upon and claims the benefit of priority from Japanese Patent Application No. 2010-032959, filed Feb. 17, 2010; the entire contents of which are incorporated herein by reference.

FIELD

Embodiments described herein relate generally to an electronic component wherein coil windings are disposed around a coil former. The other embodiments relate generally to a vehicle and an electronic apparatus in which the electronic component is installed.

BACKGROUND

Vehicles employing electronic control, such as automobiles, and electronic apparatuses, such as personal computers, comprise circuit boards on which various kinds of electronic component, such as transformers and inductors, are mounted.

A transformer comprises a former whose principal member, the former proper, is cylindrical; windings disposed around the former proper; and a magnetic core accommodated within the former. Jpn. Pat. Appln. KOKAI Publication No. 2008-205153 discloses a transformer comprising a former proper divided into two sections by a diaphragm. Each of primary and secondary windings is separately disposed around one of the two sections.

Separation tapes are wrapped around each end of the former proper to ensure sufficient creepage distance between the turns of the windings and the terminals of the transformer.

The separation tapes are also used in order for the turns to be properly aligned. By ensuring the proper alignment of the turns, the separation tapes prevent the leakage inductance increasing because of weaving of the windings.

However, it is possible for the width of manufactured tapes to vary, and it is possible for the tapes to be mispositioned on the former proper. If this happens, the turns of the windings may still weave in spite of the use of the separation tapes.

BRIEF DESCRIPTION OF THE DRAWINGS

A general architecture that implements the various feature of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an electronic component includes: a cylindrical former proper; a thick portion provided at the end of the former proper and projecting from the outer surface of the former proper; a connecting portion adjacent to the thick portion including a terminal assembly; and a wire wound around the former proper and electrically connected to the terminal assembly. The thick portion includes a first retaining portion in which the wire running from the terminal assembly to the former proper is retained.

A description will now be given of the first embodiment, with reference to FIGS. 1 to 9.

Figure 1:
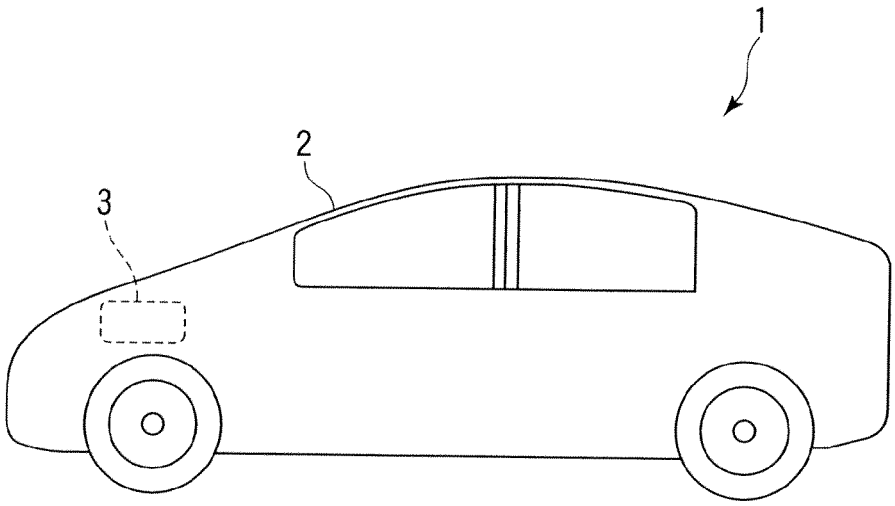
FIG. 1 is an exemplary side view showing a vehicle according to the first embodiment.

FIG. 1 is a side view schematically showing an automobile 1 according to the first embodiment. The automobile 1 is an example of a vehicle. The vehicle is not limited to an automobile, but may be a bus, a truck, a train or some other kind of vehicle.

As shown in FIG. 1, the automobile 1 comprises a vehicle proper 2 and an inverter 3. The vehicle proper 2 includes a body assembly, an engine, a transmission, a battery, and a generator. The inverter 3 is housed, for example, in an engine compartment of the vehicle proper 2 and is connected to other components such as the battery and the generator.

Figure 2:
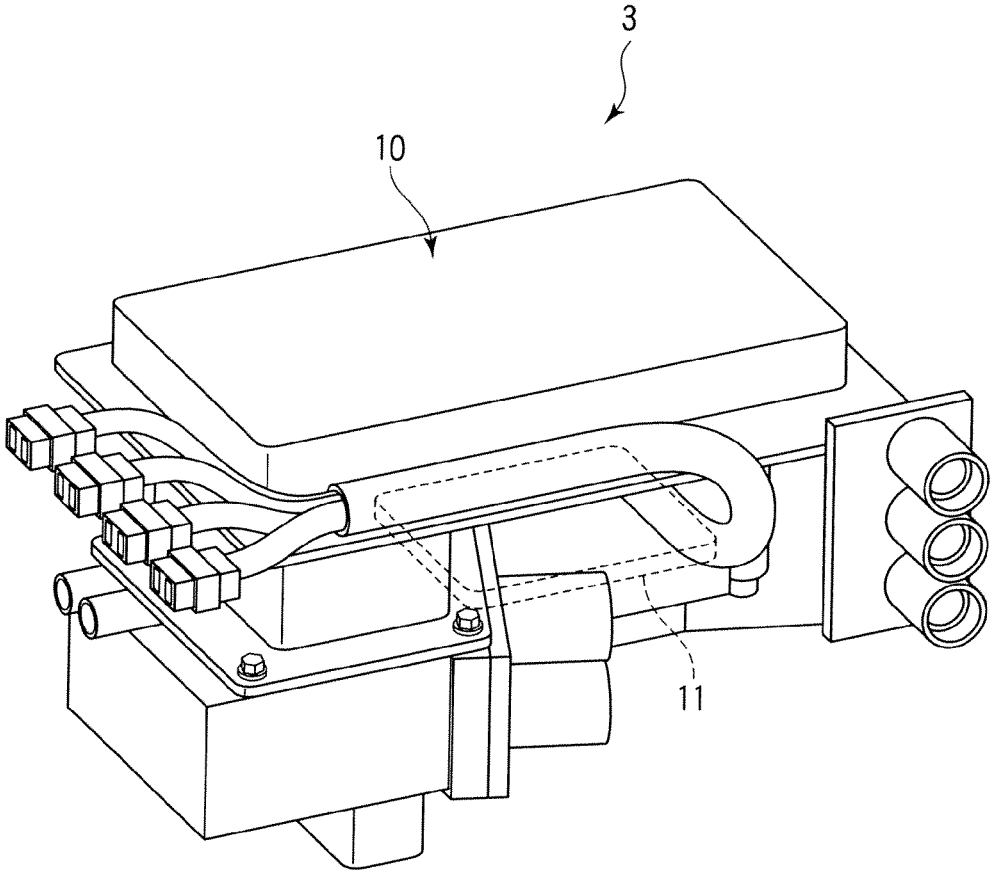
FIG. 2 is an exemplary perspective view showing an inverter of the vehicle according to the first embodiment.

FIG. 2 is a perspective view showing the inverter 3. As shown in FIG. 2, the inverter 3 comprises an inverter proper 10 and a circuit board 11. The circuit board 11 is installed in the inverter proper 10, i.e., the circuit board 11 is housed in the vehicle proper 2.

Figure 3:
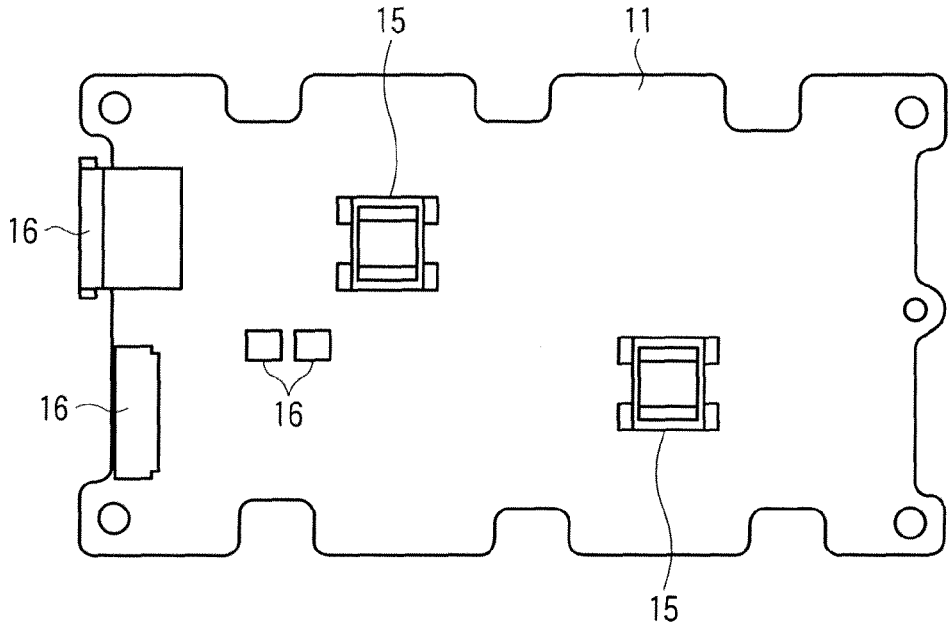
FIG. 3 is an exemplary plan view showing the circuit board of the inverter according to the first embodiment.

FIG. 3 is a plan view showing the circuit board 11. As shown in FIG. 3, a transformer 15 and the other electronic components 16 are installed in the circuit board 11. The transformer 15 is an example of an electronic component. The other electronic components 16 include a chip, a connector and other various electronic components.

Figure 4:
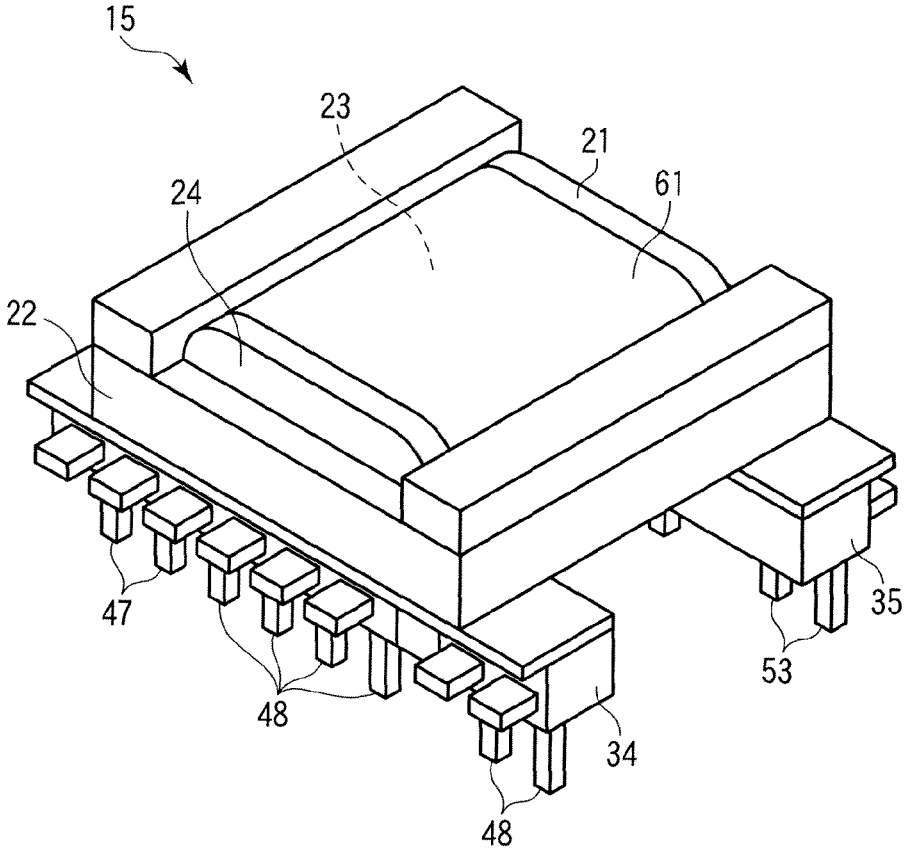
FIG. 4 is an exemplary perspective view showing the transformer according to the first embodiment.

FIG. 4 is a perspective view showing the transformer 15. The transformer 15 comprises a former 21, a magnetic core 22, a coil 23 and a fixing portion 24. The former 21 and the magnetic core 22 are combined with each other and fixed by a tape. The combined former 21 and magnetic core 22 are fixed by the fixing portion 24 formed by resin.

Figure 5:
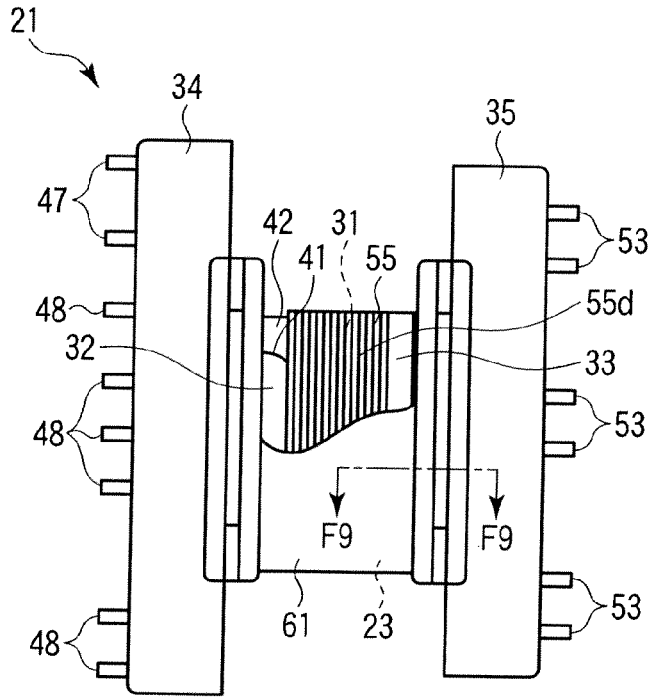
FIG. 5 is an exemplary plan view showing the former according to the first embodiment.
Figure 6:
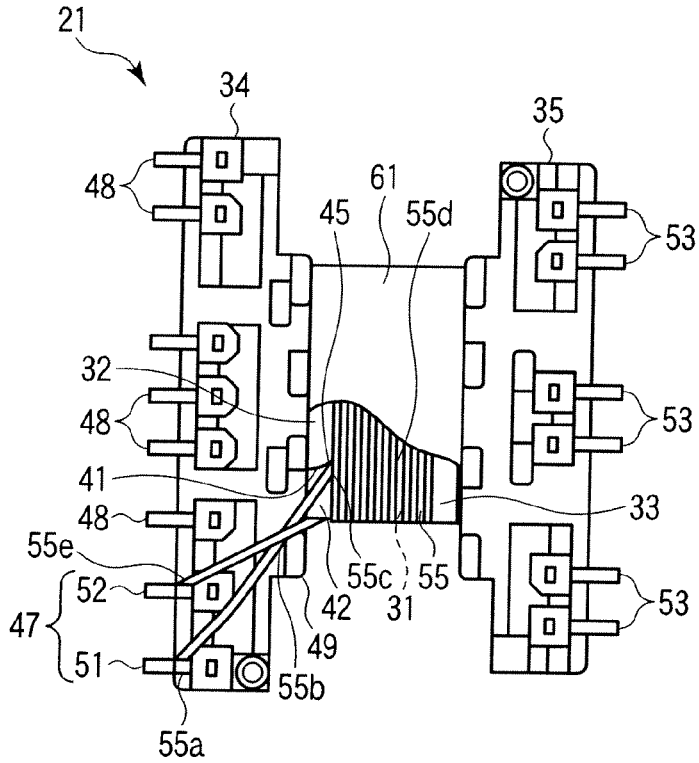
FIG. 6 is an exemplary plan view showing the former according to the first embodiment when viewed from the opposite direction to FIG. 5.
Figure 7:
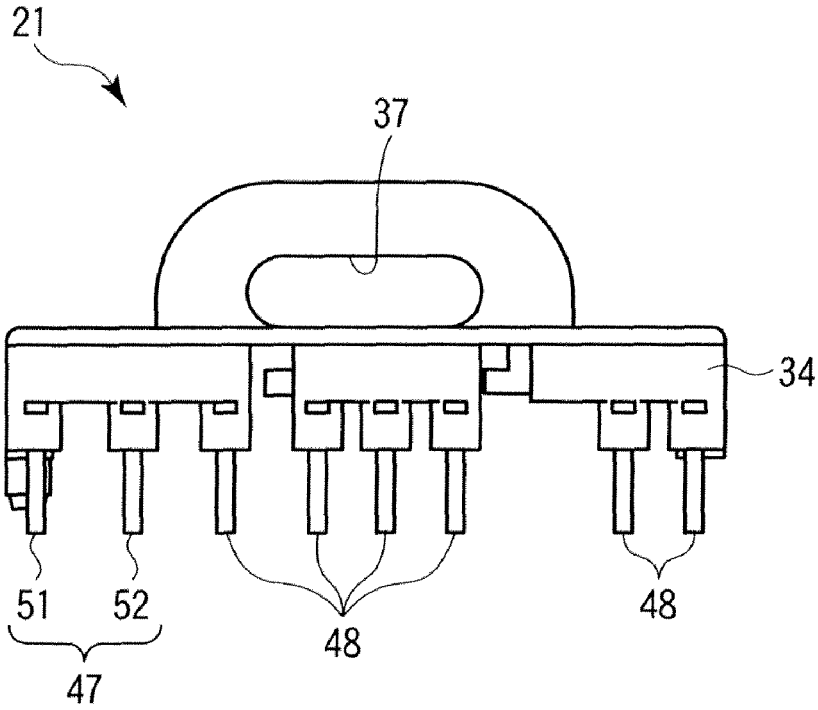
FIG. 7 is an exemplary side view showing the former according to the first embodiment.
Figure 8:
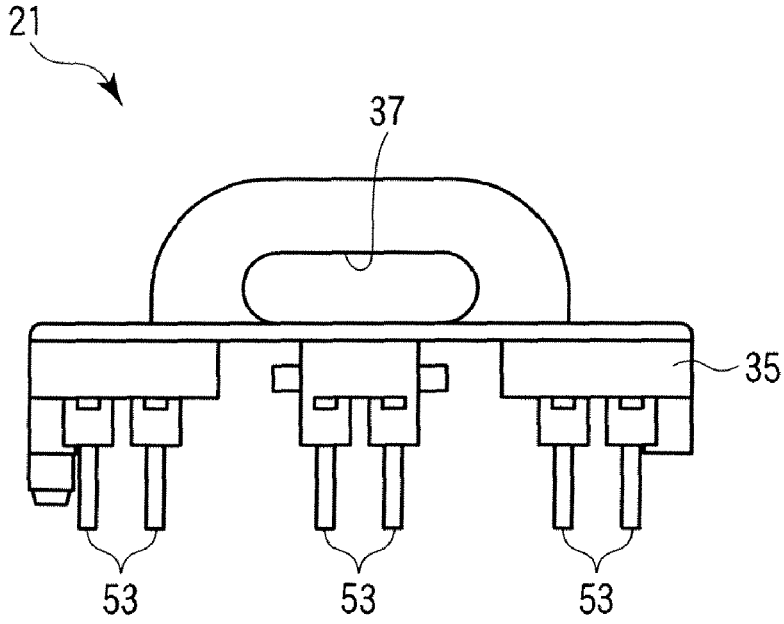
FIG. 8 is an exemplary side view showing the former according to the first embodiment when viewed from the opposite direction to FIG. 7.

FIG. 5 is a plan view showing the former 21. FIG. 6 is a plan view showing the former 21 when viewed from the opposite direction to FIG. 5. FIG. 7 is a side view showing the former 21. FIG. 8 is a side view showing the former 21 when viewed from the opposite direction to FIG. 7.

The former 21 comprises the former proper 31, a pair of thick portions 32 and 33, and a pair of connecting portions 34 and 35. The former proper 31 has a cylindrical shape. As shown in FIGS. 7 and 8, an insertion hole 37 is positioned to penetrate the former proper 31. The magnetic core 22 is inserted into the insertion hole 37.

The thick portion 32 is provided at one end of the former proper 31. The thick portion 32 is integrally formed with the former proper 31. The thick portion 33 is provided at another end of the former proper 31. The thick portions 32 and 33 are provided on the outer surface of the former proper 31.

As shown in FIG. 5, the thick portions 32 and 33 are continuously provided around the former proper 31. The shape of the thick portions 32 and 33 is not limited to the shape shown in FIG. 5. The thick portions 32 and 33 may be replaced with a plurality of protrusions arranged around the former proper 31.

As shown in FIG. 6, the thick portion 32 comprises a slot 41. The slot 41 is formed by cutting off a part of the thick portion 32 continuously provided around the former proper 31. A guide portion 42 which is a part of the former proper 31 is formed by forming the slot 41.

The thick portion 32 comprises a first retaining portion 45 which is formed by forming the slot 41. The first retaining portion 45 is a corner of thick portion 32 which is close to the former proper 31. As shown in FIG. 6, the first retaining portion 45 is rounded.

The connecting portion 34 is provided adjacent to the thick portion 32, and the connecting portion 35 is provided adjacent to the thick portion 33. The connecting portions 34 and 35 are integrally formed with the former proper 31.

As shown in FIG. 6, the connecting portion 34 comprises a terminal assembly 47, a plurality of upper layer terminals 48 and a second retaining portion 49. The terminal assembly 47 includes a first terminal 51 and a second terminal 52. All terminals are arranged in a line. The terminal assembly 47 is arranged at the end of the line in which the terminals are arranged.

The second retaining portion 49 which projects from connecting portion 34 is positioned between the terminal assembly 47 and the first retaining portion 45. The connecting portion 35 comprises a plurality of terminals 53.

Figure 9:
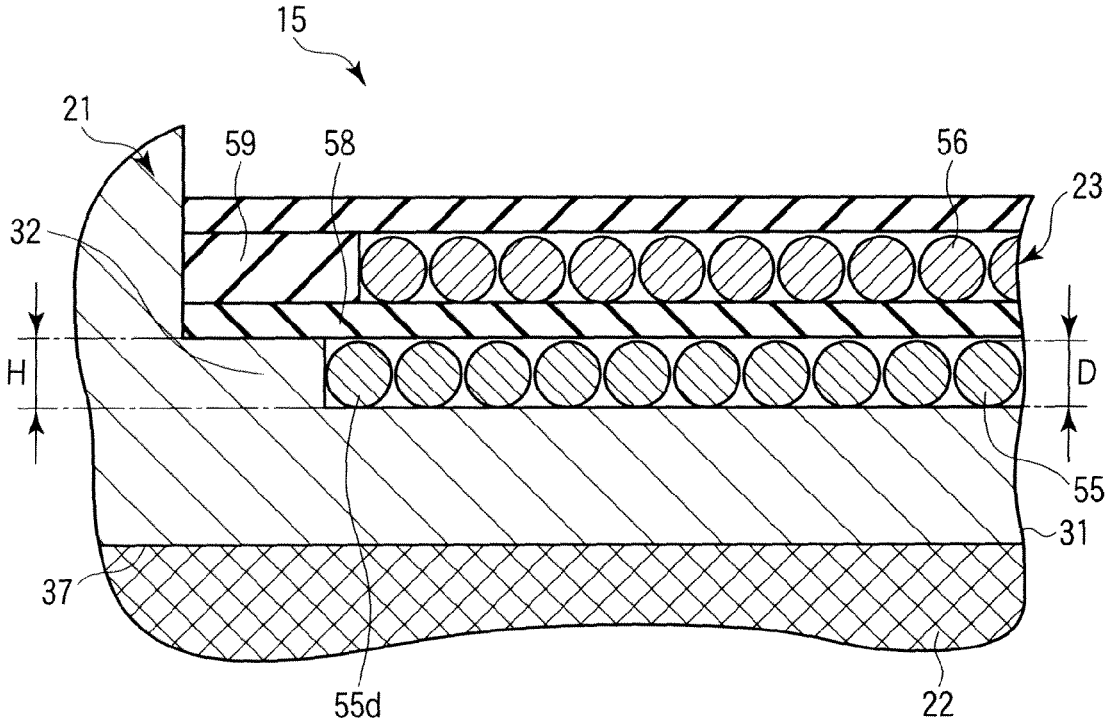
FIG. 9 is an exemplary cross-sectional view of the former shown in FIG. 5, taken along the line F9-F9.

The coil 23 comprises a first wire 55 and a second wire 56 (FIG. 9). The first wire 55 and second wire 56 are formed of copper wires covered with insulating materials.

The first wire 55 is an example of a wire. The first wire 55 includes a first end portion 55*a*, a first contact portion 55*b*, a second contact portion 55*c*, a winding portion 55*d* and a second end portion 55*e*.

The first end portion 55*a* is electrically connected to the first terminal 51, for example, by soldering. The first contact portion 55*b* which is a part of the first wire 55 between the first terminal 51 and the first retaining portion 45 is retained by the second retaining portion 49.

The second contact portion 55*c* which is a part of the first wire 55 between the second retaining portion 49 and the former proper 31 is retained by the first retaining portion 45. That is, the first wire 55 running from the terminal assembly 47 to the former proper 31 is retained by the first retaining portion 45. The second end portion 55*e* is electrically connected to the second terminal 52, for example, by soldering.

The winding portion 55*d*, which is a part of the first wire 55 starting from the second contact portion 55*c* retained by the first retaining portion 45, is wound around the former proper 31. The winding portion 55*d* is tightly wound between the thick portion 32 and the thick portion 33.

FIG. 9 is a cross-sectional view of the transformer 15 taken along the line F9-F9. As shown in FIG. 9, the height H of the thick portion 32 from the outer surface of the former proper 31 is greater than the diameter D of the first wire 55. That is, the thick portion 32 projects from the outer surface of the former proper 31 greater than the diameter D of the first wire 55.

As shown in FIG. 9, an insulating tape 58 covers the thick portions 32 and 33, the first wire 55 and the former proper 31. That is, the insulating tape 58 is wrapped around the former proper 31 over the thick portions 32 and 33 and the first wire 55. A durable insulating tape is used as the insulating tape 58.

A pair of separation tapes 59 is attached on the insulating tape 58. For example, the separation tapes 59 are attached at the end portions of the former proper over the insulating tape 58. The separation tapes 59 are durable insulating tapes.

The second wire 56 is wound around the former proper 31 over the insulating tape 58 between a pair of separation tapes 59. The second wire 56 is an example of an upper layer wire. The second wire 56 is electrically connected to the upper layer terminals 48. The second wire 56 is tightly wound between the pair of separation tapes 59. The second wire 56 is tightly wound within a pair of the separation tapes 59.

A plurality of coil layers including a plurality of wires and insulating tapes are provided on the coil layer including the second wire 56. The plurality of wires are electrically connected to the upper layer terminals 48 or the terminals 53.

As shown in FIG. 5, a cover tape 61 which is a durable insulating tape is wrapped around the former proper 31 over the plurality of coil layers including the coil layer including the second wire 56.

In the transformer 15 having the above structure, the first wire 55 is wound around the former proper 31 as described below.

The first end portion 55*a* of the first wire 55 is first soldered to the first terminal 51. The first contact portion 55*b* of the first wire 55 is retained by the second retaining portion 49. Then, the first wire 55 runs through the guide portion 42, and the second contact portion 55*c* is retained by the first retaining portion 45.

The first wire 55 extends from the first retaining portion 45 and is wound around the former proper 31. The first wire 55 is tightly disposed from the edge of the thick portion 32 to the edge of the thick portion 33.

The first wire 55 wound around the former proper 31 is retained by the second retaining portion 49. The second end portion 55*e* is soldered to the second terminal 52.

According to the transformer 15 of the automobile 1 having the above structure, the thick portions 32 and 33 are provided at the ends of the former proper 31. Employing the thick portions 32 and 33 eliminates a separation tape in order for the first wire 55 to be properly aligned around the former proper 31.

The thick portions 32 and 33 are integrally formed with the former proper 31, and the shapes and positions of the thick portions 32 and 33 relative to the former proper 31 are consistent. This structure prevents misalignment of the turns of the first wire 55 and decreases the leakage inductance, in comparison with performing alignment by using separation tapes.

The first wire 55 runs through the guide portion 42, and the second contact portion 55*c* is retained by the first retaining portion 45. The first wire 55 runs through the first retaining portion 45 via the guide portion 42 without running onto the thick portion 32. This ensures the first wire 55 being tightly wound around the former proper 31.

The terminal assembly 47 is positioned at the end of the line in which the terminals are arranged. The first wire 55 to be wound first can be electrically connected to the terminal assembly 47 arranged at the edge of connecting portion 34, and the second wire 56 and the plurality of wires included in the plurality of coil layers can be electrically connected to the upper layer terminals 48. This simplifies manufacture of the transformer 15.

The first wire 55 is retained by the first retaining portion 45, and then wound around the former proper 31. By so doing, the first wire 55 is wound along the edge of the thick portion 32 and is tightly wound around the former proper 31. In addition, the rounded first retaining portion 45 prevents the insulating materials and the copper wire from being damaged.

As shown in FIG. 9, the height H of the thick portion 32 from the outer surface of the former proper 31 is greater than the diameter D of the first wire 55. In this structure, the insulating tape 58 and the cover tape 61 is securely wrapped around the former proper 31.

The first wire 55 is retained by the second retaining portion 49. In the case where the first wire 55 is automatically wound around the former proper 31, the first wire 55 is first retained by the second retaining portion 49, and wound around the former proper 31. That is, by retaining the first wire 55 by the second retaining portion 49, machine-winding of the first wire 55 around the former proper 31 is ensured.

As description will now be given of the second embodiment with reference to FIG. 10. The structural components or elements that are similar to those of the automobile 1 of the first embodiment will be denoted by the same reference symbols, and repeated description of such components or elements will be omitted.

Figure 10:
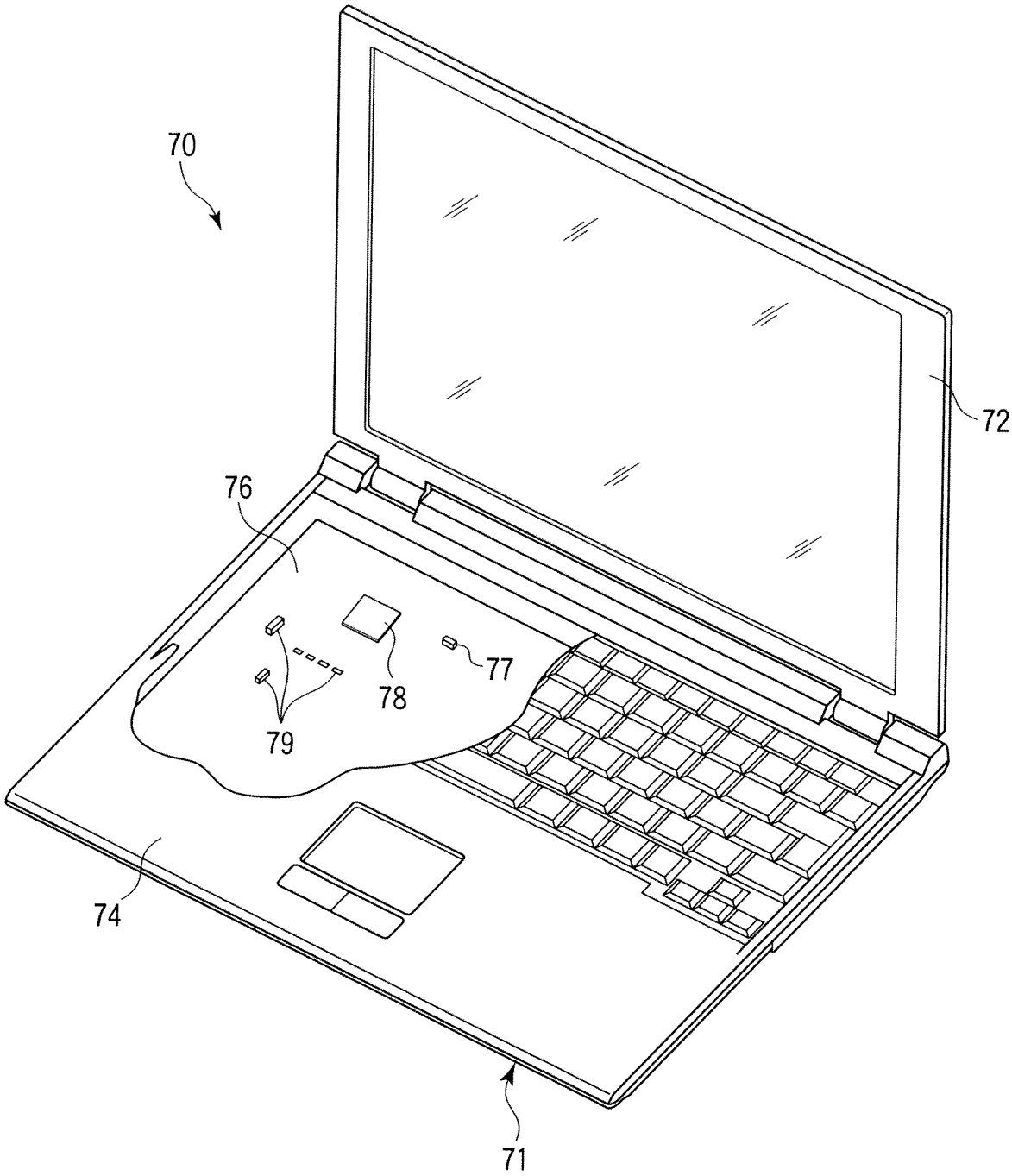
FIG. 10 is an exemplary perspective view showing a portable computer according to the second embodiment.

FIG. 10 is a perspective view showing a portable computer 70. The portable computer 70 is an example of an electronic apparatus. The electronic apparatus is not limited to a portable computer, and may be a TV, PDA, portable music player, cellular phone, or other electronic apparatuses.

The portable computer 70 comprises a computer proper 71 and a display unit 72. The computer proper 71 comprises a main housing 74 which is an example of a housing and takes the form of a flat box.

The main housing 75 houses a circuit board 76 in which a chip inductor 77, a CPU 78 and other electronic components 79 are installed. The chip inductor 77 is an example of an electronic component.

The structure of the chip inductor 77 is the same as that of the transformer 15 according to the first embodiment. That is, the chip inductor 77 comprises a cylindrical former proper 31, a thick portion 32, a connecting portion 34 and a wire 55. The thick portion 32 is provided at the end of the former proper 31, and projects from the outer surface of the former proper 31. The connecting portion 34 is provided adjacent to the thick portion 32 and comprises a terminal assembly 47. The wire 55 is electrically connected to the terminal assembly 47, and wound around the former proper 31. The thick portion 32 comprises a first retaining portion 45 in which the wire 55 running from the terminal assembly 47 to the former proper 31 is retained.

The present invention is not limited to the above embodiments and may be remodeled into various different versions as long as the essence of the invention does not fall out the scope thereof. For example, in the transformer 15 in the first embodiment, the second wire 56 is wound around the former proper 31 over the first wire 55. However, the second wire 56 may be wound around the former proper 31 in series with the first wire 55.

Further, the electronic components such as the transformer and the chip inductor having the above-mentioned structure are not limited to be applied to vehicles or electronic apparatuses, but may be applicable to an air plane or other various kinds of apparatuses or facilities. The structures similar to the transformer and the chip inductor as mentioned above may be applicable various kinds of electronic components having a coil such as a wire-wound resistance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic component comprising:

a cylindrical former proper;

a thick portion at an end of the former proper projecting from the outer surface of the former proper and comprising a first retaining portion;

a connecting portion adjacent to the thick portion comprising a terminal assembly;

a wire electrically connected to the terminal assembly and wound around the former proper; and a second retaining portion projecting from the connecting portion between the terminal assembly and the first retaining portion;

an insulating tape covering the wire and the former proper;

a pair of separation tapes wrapped around the former proper over the insulating tape; and an upper layer wire wound around the former proper over the insulating tape between the pair of separation tapes, wherein the wire running from the terminal assembly to the former proper is retained at the first retaining portion, and the second retaining portion retains the wire.

2. The electronic component of claim 1, wherein the height of the thick portion from the outer surface of the former proper is greater than the diameter of the wire.

3. The electronic component of claim 2, wherein the terminal assembly includes a first terminal and a second terminal, the wire includes a first end portion electrically connected to the first terminal, a first contact portion retained by the second retaining portion, a second contact portion retained by the first retaining portion, and a second end portion electrically connected to the second terminal.

4. The electronic component of claim 2, wherein the connecting portion further comprises a plurality of upper layer terminals arranged in line with the terminal assembly, and the terminal assembly and the other terminal are positioned at an end of the line in which the terminal assembly and the upper layer terminals are arranged.

5. The electronic component of claim 1, wherein a thickness of each separation tape of the pair of separation tapes is greater than a diameter of the wire.

6. A vehicle comprising:

a circuit board; and an electronic component installed in the circuit board, the electronic component comprising:

a cylindrical former proper, a thick portion at an end of the former proper projecting from the outer surface of the former proper and comprising a first retaining portion;

a connecting portion adjacent to the thick portion comprising a terminal assembly;

a wire electrically connected to the terminal assembly and wound around the former proper;

a second retaining portion projecting from the connecting portion between the terminal assembly and the first retaining portion;

an insulating tape covering the wire and the former proper;

a pair of separation tapes wrapped around the former proper over the insulating tape; and an upper layer wire wound around the former proper over the insulating tape between the pair of separation tapes, wherein the wire running from the terminal assembly to the former proper is retained at the first retaining portion, and the second retaining portion retains the wire.

7. An electronic apparatus comprising:

a housing;

a circuit board in the housing; and an electronic component installed in the circuit board, the electronic component comprising:

a cylindrical former proper, a thick portion at an end of the former proper projecting from the outer surface of the former proper and comprising a first retaining portion, a connecting portion adjacent to the thick portion comprising a terminal assembly;

a wire electrically connected to the terminal assembly and wound around the former proper;

a second retaining portion projecting from the connecting portion between the terminal assembly and the first retaining portion;

an insulating tape covering the wire and the former proper;

a pair of separation tapes wrapped around the former proper over the insulating tape; and an upper layer wire wound around the former proper over the insulating tape between the pair of separation tapes, wherein the wire running from the terminal assembly to the former proper is retained at the first retaining portion, and the second retaining portion retains the wire.

* * * * *